US009076381B2

(12) United States Patent
Naoaki

(10) Patent No.: US 9,076,381 B2
(45) Date of Patent: Jul. 7, 2015

(54) ORGANIC LIGHT EMITTING DISPLAY DEVICE AND DRIVING METHOD THEREOF

(75) Inventor: Komiya Naoaki, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1388 days.

(21) Appl. No.: 11/545,993

(22) Filed: Oct. 10, 2006

(65) Prior Publication Data

US 2007/0126671 A1 Jun. 7, 2007

(30) Foreign Application Priority Data

Dec. 2, 2005 (KR) ..... 10-2005-117176

(51) Int. Cl.
*G09G 3/32* (2006.01)

(52) U.S. Cl.
CPC ..... *G09G 3/3225* (2013.01); *G09G 2300/0452* (2013.01); *G09G 2300/0842* (2013.01); *G09G 2300/0861* (2013.01)

(58) Field of Classification Search
CPC ..... G09G 3/30
USPC ..... 345/82, 77, 598, 88, 152, 691, 692, 345/693, 204, 76, 206; 349/106, 143, 144
See application file for complete search history.

(56) References Cited

U.S. PATENT DOCUMENTS 6,323,871 B1 * 11/2001 Fujiyoshi et al. ..... 345/598
6,618,031 B1 * 9/2003 Bohn et al. ..... 345/83
7,158,157 B2 * 1/2007 Yamazaki et al. ..... 345/691
2003/0197666 A1 * 10/2003 Akimoto et al. ..... 345/82
2003/0227262 A1 12/2003 Kwon
2005/0030264 A1 2/2005 Tsuge et al.
2005/0093464 A1 5/2005 Shin et al.
2005/0110720 A1 * 5/2005 Akimoto et al. ..... 345/76
2005/0140597 A1 6/2005 Lee et al.
2005/0200573 A1 9/2005 Kwak
2005/0259052 A1 11/2005 Shin
2006/0012708 A1 * 1/2006 Rosmalen ..... 348/503
2010/0277449 A1 11/2010 Kanda

FOREIGN PATENT DOCUMENTS

CN 1437768 A 8/2003
CN 1670800 A 9/2005
CN 1682266 A 10/2005

(Continued)

OTHER PUBLICATIONS

Office action dated Jan. 10, 2007 for corresponding Korean patent application No. 10-2005-0117176.

(Continued)

*Primary Examiner* — Olga Merkoulova
(74) *Attorney, Agent, or Firm* — Christie, Parker & Hale, LLP

(57) ABSTRACT

An organic light emitting display device, which can independently (or freely or individually or arbitrarily) control light emission times of red, green and blue subpixels and a driving method thereof. The organic light emitting display device includes a plurality of subpixels connected with scan lines, light emitting control lines, and data lines; a scan driver for driving the scan lines and the light emitting control lines; and a data driver for driving the data lines. Here, the subpixels connected with one of the light emitting control lines generate lights of a same color.

12 Claims, 5 Drawing Sheets

(56) References Cited

FOREIGN PATENT DOCUMENTS

| | | | | | |
|---|---|---|---|---|---|
| EP | 1 686 625 | A2 | | 8/2006 | |
| JP | 2003-308042 | | | 10/2003 | |
| JP | 2003-536226 | | | 12/2003 | |
| JP | 2005-045323 | | | 2/2005 | |
| JP | 2005-196115 | | | 7/2005 | |
| JP | 2005-208346 | | | 8/2005 | |
| JP | 2005-242162 | | | 9/2005 | |
| JP | 2005-266770 | | | 9/2005 | |
| JP | 2005-321684 | | | 11/2005 | |
| JP | 2005-539253 | | | 12/2005 | |
| KR | 10-2004-0031039 | | | 4/2004 | |
| KR | 10-2005-0110961 | | | 11/2005 | |
| WO | WO 2004/025616 | | * | 3/2004 | ..... G09G 3/32 |
| WO | WO 2004/025616 | A1 | | 3/2004 | |

OTHER PUBLICATIONS

Korean Patent Abstracts, Publication No. 1020050110961 A; Publication Date: Nov. 24, 2005; in the name of You et al.

Search Report dated Apr. 17, 2008 for corresponding European Patent Application No. 06256148.5.

European Search Report dated Jun. 28, 2010, for corresponding European Patent application 06256148.5, U.S. Publication 2003/197666, and WO 2004/025616, both previously filed in an IDS dated Jul. 16, 2008.

SIPO Office action dated Dec. 1, 2010, for corresponding Chinese Patent application 200610163774.1, (6 pages).

SIPO Office action dated May 25, 2011, for corresponding Chinese Patent application 200610163774.1, (6 pages).

SIPO Patent Gazette dated Apr. 17, 2013, for corresponding Chinese Patent application 200610163774.1, (2 pages).

Japanese Office Action dated Aug. 19, 2008 of the corresponding Japanese Patent Application No. 2006/042626, noting listed references in this IDS (3 pages).

Japanese Office Action dated Mar. 17, 2009 of the corresponding Japanese Patent Application No. 2006/042626, noting listed references in this IDS (2 pages).

EPO Summons to Attend Oral Hearing dated Apr. 24, 2015, for corresponding European Patent application 06256148.5, (11 pages).

Choi, S.M., et al, "A Self-compensated Voltage Programming Pixel Structure for Active-Matrix Organic Light Emitting Diodes", AMD/OLEP A 4, IDW, Jan. 1, 2003, pp. 535-538, XP007016141A.

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2005-0117176, filed on Dec. 2, 2005, in the Korean Intellectual Property Office, the entire content of which is incorporated herein by reference.

BACKGROUND

1. Field of the Invention

The present invention relates to an organic light emitting display device and a driving method thereof, and more particularly, to an organic light emitting display device, which can individually (or freely or arbitrarily) control light emission times of red, green and blue subpixels, and a driving method thereof.

2. Discussion of Related Art

An organic light emitting display device is a flat panel display device that uses organic light emitting diodes to emit light by re-combination of electrons and holes. The organic light emitting display device has high response speed and low power consumption.

FIG. 1 is a view showing a prior organic light emitting display device.

Referring to FIG. 1, the prior organic light emitting display device includes a display region 30 having a plurality of subpixels R, G and B connected with scan lines S1 through Sn, light emitting control lines E1 through En, and data lines D1 through Dm; a scan driver 10 for driving the scan lines S1 through Sn and the light emitting control lines E1 through En; a data driver 20 for driving the data lines D1 through Dm; and a timing control part 50 for controlling the scan driver 10 and the data driver 20.

The display region 30 includes the plurality of subpixels R, G and B that are formed in areas defined by the scan lines S1 through Sn, light emitting control lines E1 through En and the data lines D1 through Dm. Here, one pixel 40 includes one red subpixel R, one green subpixel G, and one blue subpixel B. In addition, the subpixels R, G and B are arranged along one horizontal line. In other words, the red, green and blue subpixels R, G and B are alternately and repeatedly arranged along a first horizontal line to be connected with the first scan line S1.

The red subpixel R generates a red light corresponding to a data signal. For achieving this, a red organic light emitting diode (not shown in FIG. 1) is included in the red subpixel R. The green subpixel G generates a green light corresponding to a data signal. For achieving this, a green organic light emitting diode (not shown in FIG. 1) is included in the green subpixel G. The blue subpixel B generates a blue light corresponding to a data signal. For achieving this, a blue organic light emitting diode (not shown in FIG. 1) is included in the blue subpixel B.

First and second powers of first and second power sources ELVDD and ELVSS are applied to each of the subpixels R, G and B. The subpixels R, G and B to which the first and second powers of the first and second power sources ELVDD and ELVSS are applied provide a current that corresponds to a data signal through the organic light emitting diodes from the first power source ELVDD to the second power source ELVSS.

The timing control part 50 generates a data driving signal DCS and a scan driving signal SCS corresponding to synchronizing signals. The data driving signal DCS generated from the timing control part 50 is provided to the data driver 20, and the scan driving signal SCS is provided to the scan driver 10.

The scan driver 10 receives the scan driving control signal SCS. The scan driver 10, which receives the scan driving control signal SCS, sequentially provides a scanning signal to the scan lines S1 through Sn for every horizontal time period. Also, the scan driver 10, which receives the scan driving control signal SCS, sequentially provides a light emitting control signal to light emitting control lines E1 through En. Here, the width of the light emitting control signal is set to be equal to or broader than that of the scanning signal.

The data driving signal DCS is provided from the timing control part 50 to the data driver 20. The data driver 20 that receives the data driving signal DCS provides a data signal to the data lines D1 through Dm for every horizontal period.

In this prior organic light emitting display device, the light emitting efficiency and the durability characteristic of the red organic light emitting diode included in the red subpixel R, the light emitting efficiency and the durability characteristic of the green organic light emitting diode included in the green subpixel G, and the light emitting efficiency and the durability characteristic of the blue organic light emitting diode included in the blue subpixel B are different from one another. In other words, according to the materials used, light emitting efficiencies and/or durability characteristics of the red, green and blue organic light emitting diodes are different from one another. Therefore, the light emission times of the red, green and blue organic light emitting diodes need to be properly controlled. However, in the prior art, since the red, green and blue subpixels R, G and B of one pixel 40 are connected with only one scan line S, there is a problem in that each of the light emission times of the red, green and blue subpixels R, G and B could not be individually controlled.

SUMMARY OF THE INVENTION

Accordingly, it is an aspect of the present invention to provide an organic light emitting display device, which can individually control light emission times of the red, green and blue subpixels and a driving method thereof.

In one embodiment of the present invention, an organic light emitting display device includes a plurality of subpixels arranged in a plurality of horizontal lines and a plurality of vertical lines; a plurality of scan lines and a plurality of light emitting control lines connected with the subpixels and formed along the horizontal lines; and a plurality of data lines connected with the pixels and formed along the vertical lines. Here, the subpixels arranged along one of the horizontal lines generate lights of a same color.

In one embodiment of the present invention, an organic light emitting display device includes a plurality of subpixels connected with scan lines, light emitting control lines, and data lines; a scan driver for driving the scan lines and the light emitting control lines; and a data driver for driving the data lines. Here, the subpixels connected with one of the light emitting control lines generate lights of a same color.

In one embodiment of the present invention, a method of driving an organic light emitting display device is provided. The method includes: controlling a light emission time of a plurality of first subpixels placed along a first horizontal line to generate a light of a first color; controlling a light emission time of a plurality of second subpixels placed along a second horizontal line to generate a light of a second color; and controlling a light emission time of a plurality of third subpixels placed along a third horizontal line to generate a light of a third color. Here, the light emission times of the first, second, and third subpixels are set to correspond to at least one of a light emitting efficiency of the first, second, and third subpixels or a durability characteristic of the first, second, and third subpixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
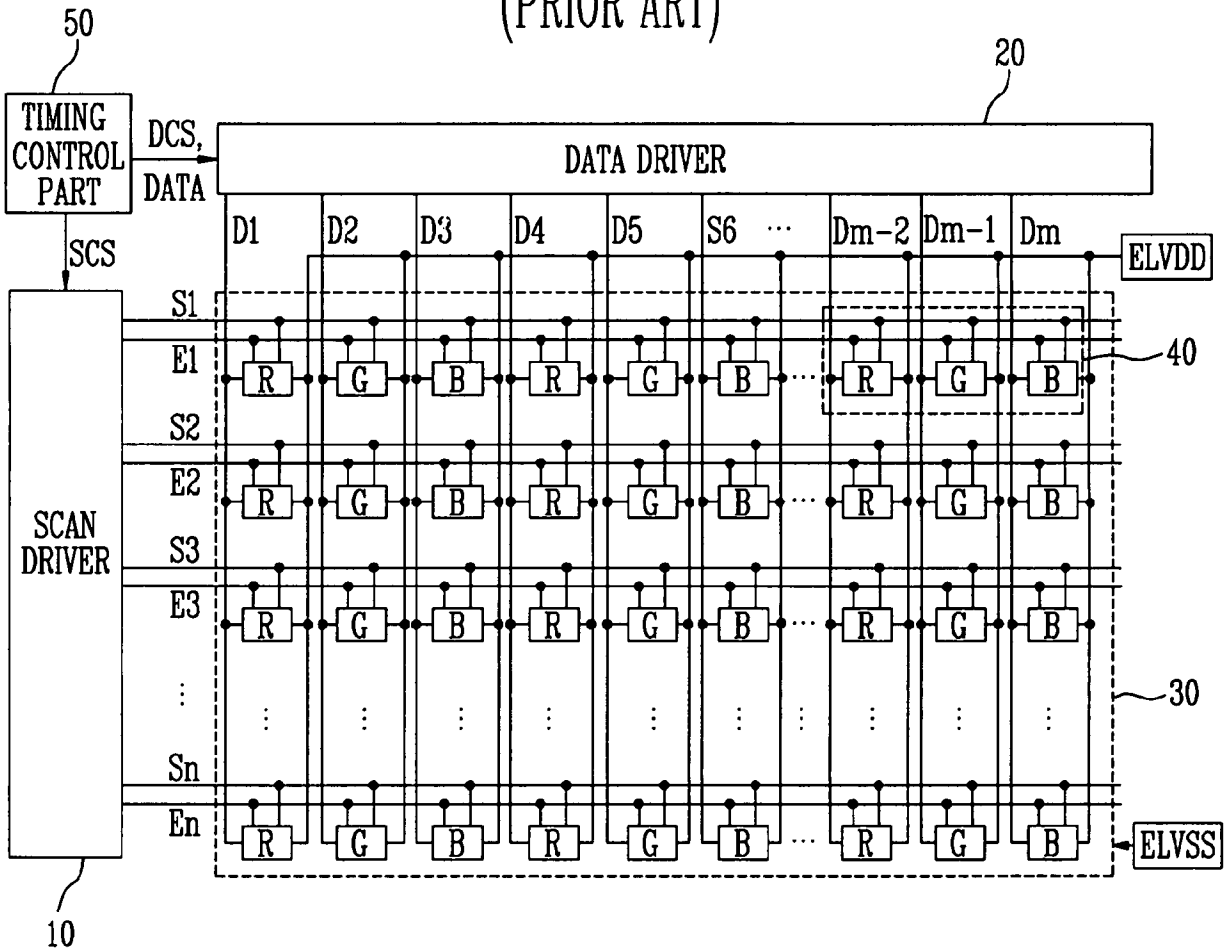
FIG. 1 (PRIOR ART)
FIG. 1 is a view showing a prior organic light emitting display device.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification as they are not essential to a complete understanding of the invention. Like reference numerals designate like elements. Here, when a first element is connected to/with a second element, the first element may be not only directly connected to/with the second element but also indirectly connected to/with the second element via a third element.

Figure 2:
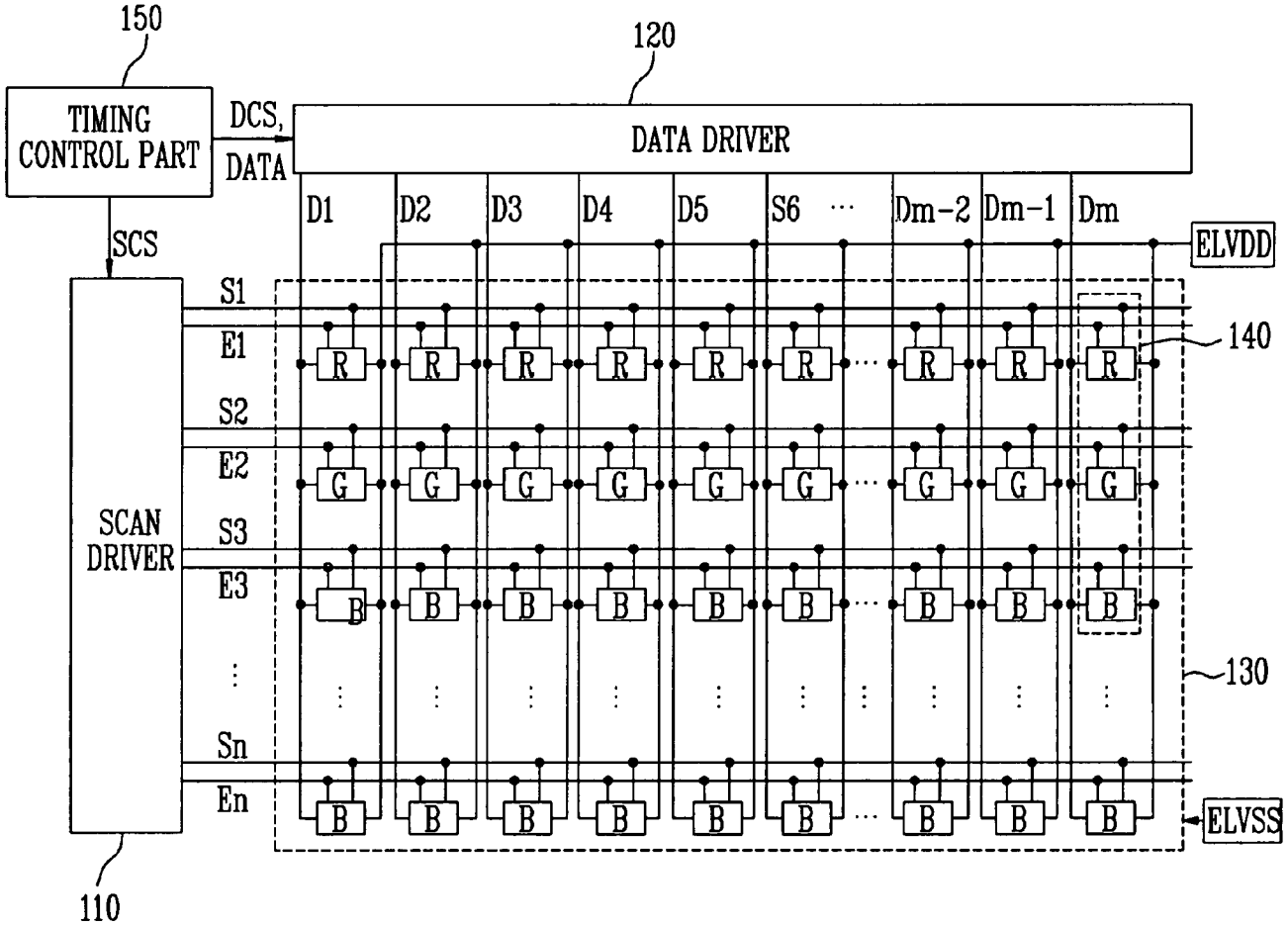
FIG. 2 is a view showing an organic light emitting display device according to an embodiment of the present invention.

FIG. 2 is a view showing an organic light emitting display device according to an embodiment of the present invention.

Referring to FIG. 2, the organic light emitting display device includes a display region 130 having a plurality of subpixels R, G and B connected with scan lines S1 through Sn, light emitting control lines E1 through En, and data lines D1 through Dm; a scan driver 110 for driving the scan lines S1 through Sn and the light emitting control lines E1 through En; a data driver 120 for driving the data lines D1 through Dm; and a timing control part 150 for controlling the scan driver 110 and the data driver 120.

The display region 130 includes the plurality of subpixels R, G and B that are formed in areas defined by the scan lines S1 through Sn, the light emitting control lines E1 through En and the data lines D1 through Dm. Here, one pixel 140 includes one red subpixel R, one green subpixel G, and one blue subpixel B. In addition, the subpixels R, G and B for emitting (or generating) one (or the same) color (e.g., red, green, or blue) are arranged to be connected with one scan line S and one light emitting control line E.

For example, the first scan line S1 and the first light emitting control line E1 are connected with the red subpixels R, the second scan line S2 and the second light emitting control line E2 are connected with the green subpixels G, and the third scan line S3 and the third light emitting control line E3 are connected with the blue subpixels B. That is, according to the present invention, the subpixels R, G and B are arranged such that the respective subpixels R, G and B for generating the same color are arranged along one horizontal line.

In the above example, the red subpixels R generate a red light corresponding to the data signal that is provided from the data lines D1 through Dm. To achieve this, each of the red subpixels R includes red organic light emitting diodes. Also, a light emission time of the red subpixels R is controlled by the light emitting control signal that is provided from the light emitting control line E1 connected with the red subpixels R.

The green subpixels G generate a green light corresponding to the data signal that is provided from the data lines D1 through Dm. To achieve this, each of the green subpixels G includes green organic light emitting diodes. Also, a light emission time of the green subpixels R is controlled by the light emitting control signal that is provided from the light emitting control line E2 connected with the green subpixels G.

The blue subpixels B generate a blue light corresponding to the data signal that is provided from the data lines D1 through Dm. To achieve this, each of the blue subpixels B includes blue organic light emitting diodes. Also, a light emission time of the blue subpixels B is controlled by the light emitting control signal that is provided from the light emitting control line E3 connected with the blue subpixels B.

The timing control part 150 generates a data driving signal DCS and a scan driving signal SCS corresponding to synchronizing signals. The data driving signal DCS generated from the timing control part 150 is provided to the data driver 120, and the scan driving signal SCS is provided to the scan driver 110.

The scan driver 110 receives the scan driving control signal SCS. The scan driver 110, which receives the scan driving control signal SCS, sequentially provides a scanning signal to the scan lines S1 through Sn for every horizontal time period. Also, the scan driver 110, which receives the scan driving control signal SCS, sequentially provides a light emitting control signal to light emitting control lines E1 through En. Here, the width of the light emitting control signal may be determined by a light emitting efficiency and/or a durability characteristic.

Figure 3:
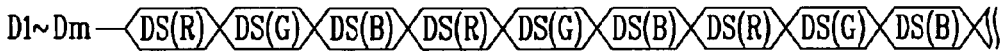
FIG. 3 is a view showing a data signal provided to the data driver depicted in FIG. 2.

The data driving signal DCS is provided from the timing control part 150 to the data driver 120. The data driver 120 that receives the data driving signal DCS provides a data signal to the data lines D1 through Dm for every horizontal period. Here, because the red subpixel R, the green subpixel G, and the blue subpixel B are alternately and repeatedly arranged for every vertical line, the data driver 120 alternately and repeatedly provides a red data signal DS(R), a green data signal. DS(G), and a blue data signal DS(B) to each of the data lines D1 through Dm as shown in FIG. 3.

Figure 4:
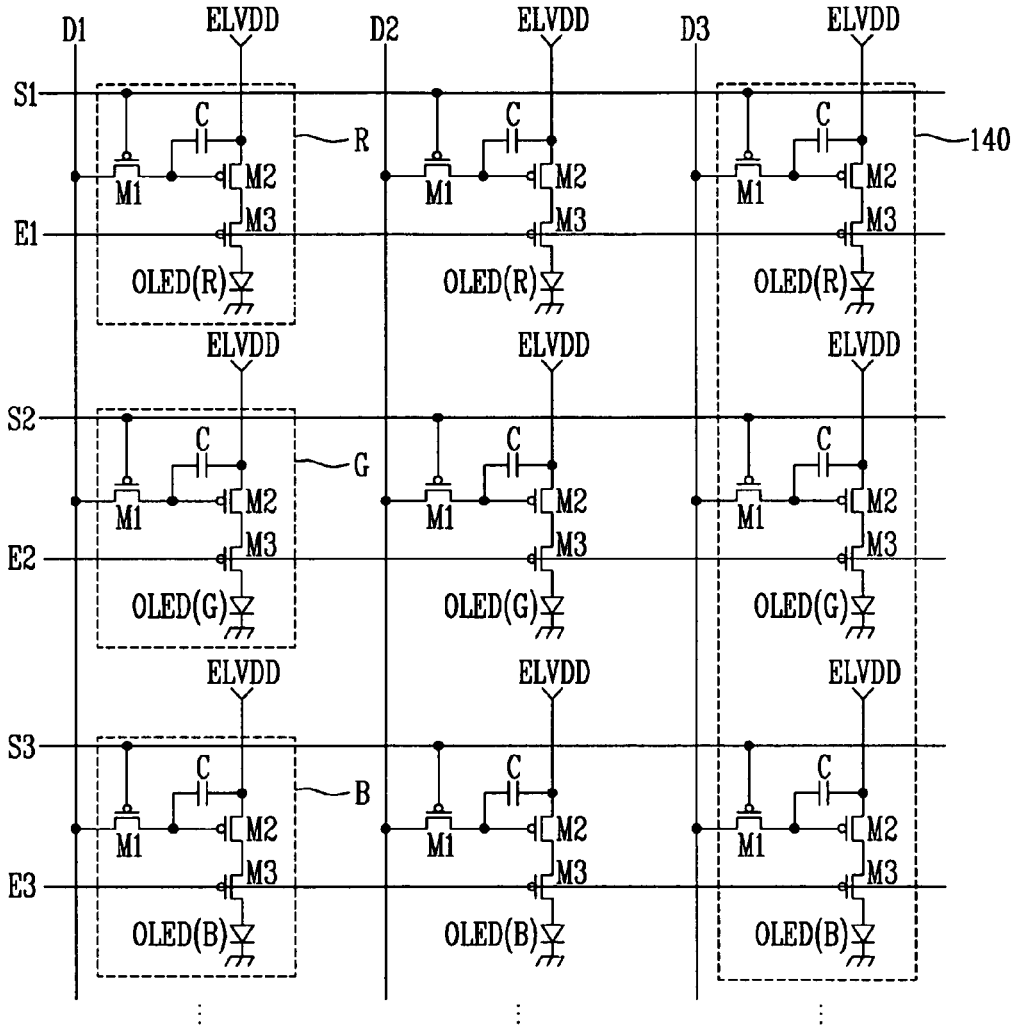
FIG. 4 is a view showing a subpixel according to an embodiment of the present invention.

FIG. 4 is a view showing a subpixel according to an embodiment of the present invention.

Referring to FIG. 4, each of the subpixels R, G and B includes an organic light emitting diode OLED, transistors M1 through M3 for controlling a current provided to the organic light emitting diode OLED, and a storage capacitor C for storing a voltage corresponding to a data signal.

The organic light emitting diode OLED generates a light of a luminance corresponding to the amount of current provided thereto, wherein the luminance may be predetermined. Here, a red organic light emitting diode OLED(R) included in the red subpixel R generates a red light corresponding to the amount of current, a green organic light emitting diode OLED (G) included in the green subpixel G generates a green light corresponding to the amount of current, and a blue organic light emitting diode OLED(B) included in the blue subpixel B generates a blue light corresponding to the amount of current.

The gate of the first transistor M1, which is included in each of the subpixels R, G, B, is connected with the scan line S (e.g., one of the scan lines S1, S2, S3, etc.), the first electrode of the first transistor M1 is connected with the data line D (e.g., one of the data lines D1, D2, D3, etc.), and the second electrode of the first transistor M1 is connected with a first electrode of the storage capacitor C and the gate of the second transistor M2. The first transistor M1 is turned on to thereby provide the data signal provided from the data line D to the storage capacitor C when the scan signal is provided form the scan line S to the first transistor M1. At this time, the storage capacitor C is charged with a voltage corresponding to a voltage difference between the data signal and a first power (or voltage) of a first power source ELVDD. That is, when the data signal is provided to the storage capacitor C, the storage capacitor C is charged with a voltage corresponding to a voltage difference between the data signal and the first power of the first power source ELVDD.

The gate of the second transistor M2 is connected with the first electrode of the storage capacitor C, the first electrode of the second transistor M2 is connected with the first power source ELVDD, and the second electrode of the second transistor M2 is connected with the first electrode of the third transistor M3. The second transistor M2 controls the amount of current flowing from the first power source ELVDD to the light emitting diode OLED corresponding to the voltage charged in the storage capacitor C.

The gate of the third transistor M3 is connected with the light emitting control line E (e.g., one of the light emitting control lines E1, E2, E3, etc.), the first electrode of the third transistor M3 is connected with the second electrode of the second transistor M2, and the second electrode of the third transistor M3 is connected with the organic light emitting diode OLED. The third transistor M3 is turned on to provide a current from the second transistor M2 to the organic light emitting diode OLED when the light emitting control signal is not provided to the third transistor M3 (or when the light emitting control signal is not at a high level). That is, the third transistor M3 controls a time that a current is provided from the second transistor M2 to the organic light emitting diode OLED.

Figure 5:
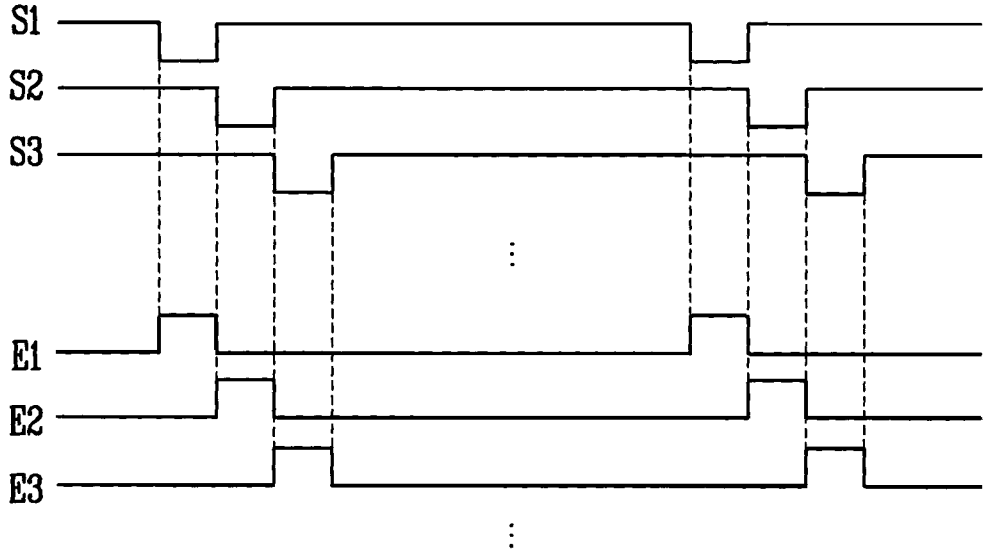
FIG. 5 is a view showing a driving waveform according to a first embodiment of the present invention.

FIG. 5 is a view showing one example of a driving waveform provided to the subpixels depicted in FIG. 4.

Referring to FIG. 5, the scan signal and the light emitting control signal are sequentially provided to the scan lines S1 through Sn and the light emitting control lines E1 through En, respectively.

When the scan signal is provided to the first scan line S1 (or is at a low level), the first transistor M1, which is included in the subpixels R connected with the first scan line S1, is turned on. At this time, the data signal, which is provided to the data lines D1 through Dm, is provided to the subpixels R connected with the first scan line S1. Then, the storage capacitor C is charged with a voltage corresponding to the data signal.

In FIG. 5, the light emitting control signal is provided to the first light emitting control line E1 (i.e., at a high level) when the scan signal (i.e., at a low level) is provided to the first scan line S1. When the light emitting control signal is provided to the first light emitting control line E1, the third transistor M3, which is included in the subpixels R connected with the first light emitting control line E1, is turned off. Therefore, while the storage capacitor C is charged with the voltage corresponding to the data signal, a current is not provided to the organic light emitting diode OLED(R) by the scan signal provided to the first scan line S1. Next, the supply of the scan signal and the light emitting control signal respectively to the first scan line S1 and the first light emitting control line E1 is ceased, such that the third transistor M3 is turned on. Then, a current that corresponds to the charged voltage in the storage capacitor C is provided to the organic light emitting diode OLED(R) such that a red light (e.g., a red light of a predetermined luminance) is emitted from the organic light emitting diode OLED(R).

In addition, the storage capacitor C, which is included in each subpixel G connected with the second scan line S2, is charged with the voltage corresponding to the data signal by the scan signal and the light emitting control signal respectively provided to the second scan line S2 and the second light emitting control line E2, and a green light (e.g., a green light of a predetermined luminance) is emitted from the organic light emitting diode OLED(G) corresponding to the voltage stored by the storage capacitor C.

Also, the storage capacitor C, which is included in each subpixel B connected with the third scan line S3, is charged with the voltage corresponding to the data signal by the scan signal and the light emitting control signal respectively provided to the third scan line S3 and the third light emitting control line E3, and a blue light (e.g., a blue light of a predetermined luminance) is emitted from the organic light emitting diode OLED(B) corresponding to the voltage stored by the storage capacitor C.

As such, by repeating the above processes, the subpixels R, G and B display an image on the display region 130.

In view of the above, since the subpixels connected with one light emitting control line E generate lights of the same color, the light emission times of red, green and blue lights can be individually (or independently or freely) controlled by using the light emitting control signal. In other words, according to the present invention, the light emission times of the red, green and blue subpixels R, G and B can be individually (or independently or arbitrarily) controlled.

For example, in the present invention, considering the light emitting efficiencies of the red, green and blue organic light emitting diodes OLED(R), OLED(G) and OLED(B), the light emission times of the red, green and blue subpixels R, G and B can be controlled. That is, the light emission time of a subpixel including an organic light emitting diode having a higher light emitting efficiency is set shorter than that of a subpixel including an organic light emitting diode having a lower light emitting efficiency, such that a white balance of an image is properly adjusted to be displayed.

In one embodiment, according to the characteristics of materials used for the red, green and blue organic light emitting diodes OLED(R), OLED(G) and OLED(B), the light emitting efficiency of the green subpixel G is the highest and the light emitting efficiencies of the red and blue subpixels R and B are similar to each other.

Figure 6:
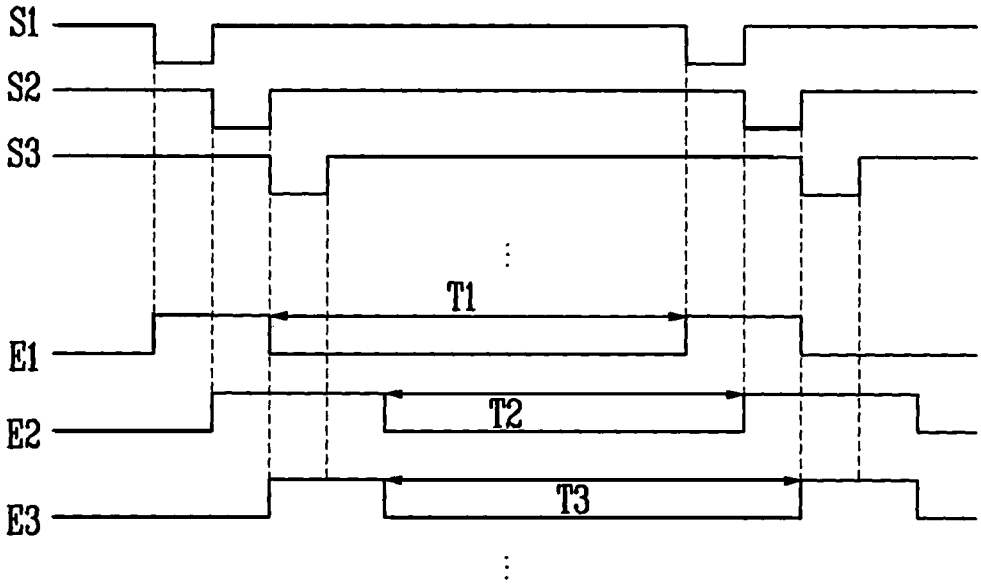
FIG. 6 is a view showing a driving waveform according to a second embodiment of the present invention.

Therefore, considering the above described light emitting efficiencies of the red, green and blue organic light emitting diodes OLED(R), OLED(G) and OLED(B), the widths of light emitting control signals are set as shown in FIG. 6.

Referring to FIG. 6, the width of the light emitting control signal provided to the light emitting control lines E1 and E3 respectively connected with the red and blue subpixels R and B is shorter than that of the width of the light emitting control signal provided to the light emitting control lines E2 connected with the green subpixels G. As such, the light emission times T1 and T3 of the red and blue subpixels R and B are longer than the light emission time T2 of the green subpixel G, such that a white balance of an image is properly adjusted to be displayed.

In addition, considering durability characteristics of the red, green and blue organic light emitting diodes OLED(R), OLED(G) and OLED(B), the light emission times of the red, green and blue subpixels R, G and B can be controlled. In other words, the light emission time of a subpixel having a longer durability characteristic is set longer than that of the light emission time of a subpixel having a shorter durability characteristic, such that the durability of subpixels may be set to be similar to one another.

Figure 7:
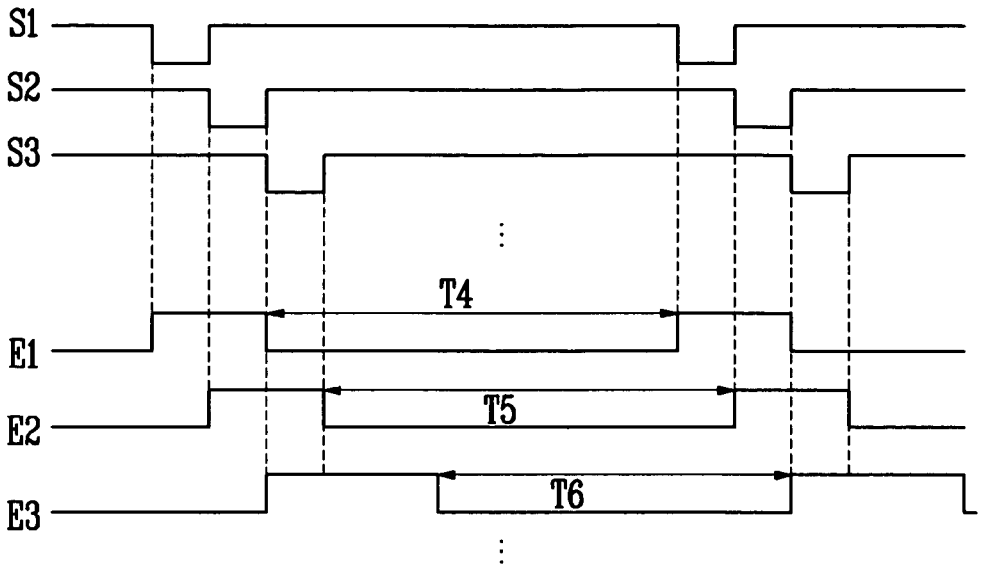
FIG. 7 is a view showing a driving waveform according to a third embodiment of the present invention.

For example, if the durability of the blue organic light emitting diode OLED(B) is the shortest, and the durability of the red and green organic light emitting diode OLED(R) and OLED(G) are similar to each other, the width of the light emitting control signal can be set as shown in FIG. 7.

Referring to FIG. 7, the width of the light emitting control signal provided to the light emitting control lines E1 and E2 respectively connected with the red and green subpixels R and G is set to be longer than that of the width of the light emitting control signal provided to the light emitting control line E3. As such, the light emission times T4 and T5 of the red and green subpixels R and G are set to be longer than the light emission time T6 of the blue subpixel B, such that the durability characteristics of the subpixels are similarly maintained. In other words, by allowing the blue subpixel B having a shorter durability characteristic to emit light for a time that is shorter than the emission times of the other subpixels R and G, the durability characteristics of the subpixels R, G and B can be adjusted.

That is, according to the present invention, by controlling the width of the light emitting control signal as occasion demands, the light emission times of the red, green and blue subpixels R, G and B can be freely controlled.

A structure of a subpixel according to embodiments of the present invention can be modified with various suitable subpixel structures having a transistor controlled by a light emitting control signal, and the present invention is not limited by the above described embodiments.

Figure 8:
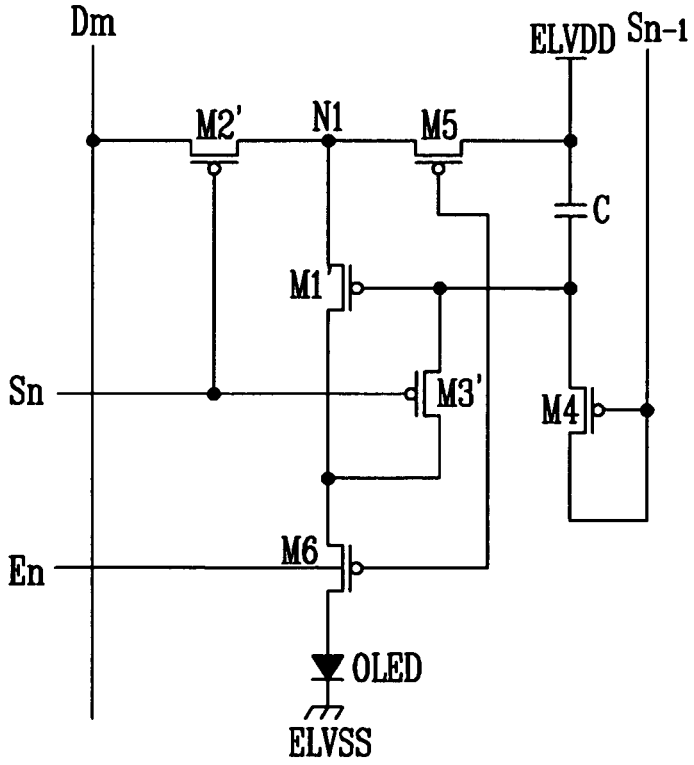
FIG. 8 is a view showing a subpixel according to another embodiment of present invention.

FIG. 8 is a view showing a subpixel according to another embodiment of the present invention.

Referring to FIG. 8, the subpixel includes an organic light emitting diode. OLED, transistors M1', M2', M3', M4, M5, and M6 for controlling a current provided to the organic light emitting diode OLED, and a storage capacitor C' for storing a voltage corresponding to a data signal The organic light emitting diode OLED generates a light having a luminance corresponding to the amount of current provided to the organic light emitting diode OLED, wherein the luminance may be predetermined. Here, a red organic light emitting diode OLED(R) included in a red subpixel R generates a red light corresponding to the amount of current, and a green organic light emitting diode OLED(G) included in a green subpixel R generates a green light corresponding to the amount of current, and a blue organic light emitting diode OLED(B) included in a blue subpixel B generates a blue light corresponding to the amount of current.

The first electrode of the second transistor M2' is connected with a data line Dm, and the second electrode of the second transistor M2' is connected with a first node N1. The gate of the second transistor M2' is connected with an n-th scan line Sn. The second transistor M2' is turned on to provide a data signal provided to the data line Dm to the first node N1 when a scan signal is provided to the n-th scan line Sn.

The first electrode of the first transistor M1' is connected with the first node N1, and the second electrode of the first transistor M1' is connected with the first electrode of the sixth transistor M6. The gate of the first transistor M1' is connected with the storage capacitor C'. The first transistor M1' provides the organic light emitting diode OLED with a current corresponding to the voltage charged in the storage capacitor C'.

The first electrode of the third transistor M3' is connected with the second electrode of the first transistor M1', and the second electrode of the third transistor M3' is connected with the gate of the first transistor M1'. The gate of the third transistor M3' is connected with the n-th scan line Sn. The third transistor M3' is turned on to allow the first transistor M1' to be diode-connected (or is turned to electrically connect the gate of the first transistor M1' and the second electrode of the first transistor M1' with each other) when the scan signal is provided to the n-th scan line Sn.

The first electrode of the fourth transistor M4 is connected with an (n−1)th scan line Sn−1, and the second electrode of the fourth transistor M4 is connected with the storage capacitor C' and the gate of the first transistor M1'. The fourth transistor M4 is turned on to reset the gate of the first transistor M1' and the storage capacitor C' when the scan signal is provided to the (n−1)th scan line Sn−1.

The first electrode of the fifth transistor M5 is connected with a first power source ELVDD, and the second electrode of the fifth transistor M5 is connected with the first node N1. The gate of the fifth transistor M5 is connected with a light emitting control line En. The fifth transistor M5 is turned on to allow the first power source ELVDD and the first node N1 to be electrically connected with each other when the light emitting control signal is not provided from the light emitting control line En.

The first electrode of the sixth transistor M6 is connected with the second electrode of the first transistor M1', and the second electrode of the sixth transistor M6 is connected with the anode of the organic light emitting diode OLED. The gate of the sixth transistor M6 is connected with the light emitting control line En. The sixth transistor M6 is turned on to provide a current from the first transistor M1' to the organic light emitting diode OLED when the light emitting control signal is not provided to the sixth transistor M6.

Explaining the operation process in brief, the scan signal is provided to the (n−1)th scan line Sn−1, such that the fourth transistor M4 is turned on. When the fourth transistor M4 is turned on, the storage capacitor C' and the first transistor M1' are connected with the (n−1)th scan line Sn−1. Then, the storage capacitor C' and the gate of the first transistor M1' are reset with the voltage of the scan signal. Here, the voltage value of the scan signal is set to be lower than that of the data signal.

Next, the scan signal is provided to the n-th scan line Sn. When the scan signal is provided to the n-th scan line Sn, the second and third transistors M2' and M3' are turned on. When the second transistor M2' is turned on, the first transistor M1' is diode-connected by the transistor M3'. When the second transistor M2' is turned on, the data signal provided to the data line Dm is provided through the second transistor M2' to the first node N1. At this time, since the gate voltage of the first transistor M1' is initialized by the scan signal (i.e., the gate voltage is set to be lower than that of the data signal provided to the first node N1), the first transistor M1' is turned on.

When the first transistor M1' is turned on, the data signal that is applied to the first node N1 is provided through the first and third transistors M1' and M3' to the storage capacitor C'. Here, since the data signal is provided through the first transistor M1', which is diode-connected, to the storage capacitor C', the storage capacitor C' is charged with a voltage corresponding to the data signal and a threshold voltage of the first transistor M1'. After charging the storage capacitor C' with the voltage corresponding to the data signal and the threshold voltage of the first transistor M1', the supply of the light emitting control signal (e.g., EM1) is ceased for a particular time period, such that fifth and sixth transistors M5 and M6 are turned on. Here, the time period for supplying the light emitting control signal (e.g., EM1) is set by considering the durability characteristic and/or efficiency characteristic of the organic light emitting diode OLED. That is, the first transistor M1' controls the current flowing from the first power source ELVDD to the organic light emitting diode OLED corresponding to the voltage charged to the storage capacitor C'.

As mentioned above, in an organic light emitting display device and driving method thereof, by connecting subpixels for generating one color with one of the light emitting control lines (i.e., by arranging a set of the subpixels for generating the same color along one horizontal line, the light emission times of the subpixels for generating different colors can be independently or freely controlled). Indeed, according to embodiments of the present invention, the light emission time of the subpixels can be controlled by considering the light emitting efficiency and/or durability characteristic of the organic light emitting diodes in the subpixels.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display device comprising:

a plurality of subpixels arranged in a plurality of horizontal lines and a plurality of vertical lines;

a plurality of scan lines and a plurality of light emitting control lines connected with the plurality of subpixels and formed along the plurality of horizontal lines;

a plurality of data lines connected with the plurality of subpixels and formed along the plurality of vertical lines, wherein the plurality of subpixels arranged along one of the plurality of horizontal lines are connected to one of the plurality of light emitting control lines, and are configured to generate lights of a same color; and a scan driver for driving the scan lines and the light emitting control lines, wherein the subpixels comprise:

an organic light emitting diode;

red subpixels, wherein the organic light emitting diode of the red subpixels comprises a red organic light emitting diode, green subpixels, wherein the organic light emitting diode of the green subpixels comprises a green organic light emitting diode; and blue subpixels, wherein the organic light emitting diode of the blue subpixels comprises a blue organic light emitting diode, wherein an emission time of the subpixels is controlled according to a light emitting control signal provided to the light emitting control lines, wherein the scan driver controls a width of the light emitting control signal provided to the light emitting control lines to correspond to a light emitting efficiency of the red, green and blue organic light emitting diodes, and wherein the scan driver controls the width of the light emitting control signal to provide the subpixels having a higher organic light emitting diode emission efficiency with a shorter emission time than the subpixels having a lower organic light emitting diodes emission efficiency, wherein the scan driver controls a width of the light emitting control signal to correspond to a durability characteristic of the red, green and blue organic light emitting diodes, and wherein the scan driver controls the width of the light emitting control signal to provide the subpixels having a longer organic light emitting diode durability characteristic with a longer emission time than the subpixels having a shorter organic light emitting diode durability characteristic.

2. The organic light emitting display device as claimed in claim 1, further comprising:

a data driver for driving the data lines.

3. The organic light emitting display device as claimed in claim 1:

wherein the plurality of subpixels include red subpixels having a red organic light emitting diode, green subpixels having a green organic light emitting diode, and blue subpixels having a blue organic light emitting diode; and wherein the red, green and blue subpixels of the plurality of subpixels are repeatedly arranged along each of the vertical lines.

4. The organic light emitting display device as claimed in claim 1, wherein the scan driver controls the width of the light emitting control signal to provide the green subpixels with a shorter emission time than the red and blue subpixels.

5. The organic light emitting display device as claimed in claim 1, wherein the scan driver controls the width of the light emitting control signal to provide the blue subpixels with a shorter emission time than the red and green subpixels.

6. The organic light emitting display device as claimed in claim 1, wherein one pixel is formed by one of the red subpixels, one of the green subpixels, and one of the blue subpixels.

7. The organic light emitting display device as claimed in claim 1, wherein each of the plurality of subpixels comprises:

a first transistor electrically coupled between a power source and the organic light emitting diode;

a second transistor electrically coupled between one of the data lines and an electrode of the first transistor; and a capacitor electrically coupled between the power source and the electrode of the first transistor.

8. The organic light emitting display device as claimed in claim 7, wherein for each of the plurality of subpixels the second transistor is configured to turn on when a scan signal is provided to one of the scan lines such that a data signal is provided from the one of the data lines to the second transistor;

the capacitor is configured to charge a voltage corresponding to the data signal;

the first transistor is configured to provide the organic light emitting diode with a current corresponding to the voltage of the capacitor; and wherein each of the plurality of subpixels further comprises a third transistor configured to control a time of supplying the current to the organic light emitting diode to correspond to the light emitting control signal.

9. The organic light emitting display device as claimed in claim 3, wherein one pixel is formed by one of the red subpixels, one of the green subpixels, and one of the blue subpixels.

10. A method of driving an organic light emitting display device, the method comprising:

controlling a light emission time of a plurality of first subpixels placed along a first horizontal line to generate a light of a first color;

controlling a light emission time of a plurality of second subpixels placed along a second horizontal line to generate a light of a second color; and controlling a light emission time of a plurality of third subpixels placed along a third horizontal line to generate a light of a third color, wherein the light emission times of the first, second and third subpixels are set to correspond to at least one of a light emitting efficiency of the first, second and third subpixels or a durability characteristic of the first, second and third subpixels, and wherein the first subpixels generate a red color light, the second subpixels generate a green color light, and the third subpixels generate a blue color light, wherein the light emission times of the first, second and third subpixels are set to be inversely proportional to the light emitting efficiency of the first, second and third subpixels, wherein the light emission times of the first, second, and third subpixels are set to be proportional to the durability characteristic of the first, second and third subpixels.

11. The method of driving an organic light emitting display device as claimed in claim 10, wherein the first, second and third subpixels are respectively connected with a different one of the light emitting control lines, and wherein the light emission times of the first, second, and third subpixels are controlled according to a light emitting control signal provided to the light emitting control lines.

12. The method of driving an organic light emitting display device as claimed in claim 10, wherein one of the first, second, and third subpixels comprises:

an organic light emitting diode;

a first transistor electrically coupled between a power source and the organic light emitting diode;

a second transistor electrically coupled between a data line and an electrode of the first transistor; and a capacitor electrically coupled between the power source and the electrode of the first transistor.

* * * * *